United States Patent [19]

Espiritu

[11] Patent Number: 4,477,140

[45] Date of Patent: Oct. 16, 1984

[54] SELF-LOCKING CONNECTOR

[75] Inventor: Hermenegildo A. Espiritu, Cerritos, Calif.

[73] Assignee: International Telephone & Telegraph Corporation, New York, N.Y.

[21] Appl. No.: 464,238

[22] Filed: Feb. 7, 1983

[51] Int. Cl.[3] ..... H01R 13/623

[52] U.S. Cl. ..... 339/89 M; 339/DIG. 2

[58] Field of Search ..... 339/DIG. 2, 113 R, 89 R, 339/89 C, 89 M, 90 R, 90 C; 285/82, 89

[56] References Cited

U.S. PATENT DOCUMENTS

| | | | |
|---|---|---|---|
| 2,728,895 | 12/1955 | Quackenbush et al. | 339/89 |
| 2,890,434 | 6/1959 | Ray et al. | 339/DIG. 2 |
| 3,455,580 | 7/1969 | Howard | 339/90 R |
| 3,947,081 | 3/1976 | Peterson | 339/75 |
| 3,971,614 | 7/1976 | Paoli et al. | 339/89 |
| 4,030,798 | 6/1977 | Paoli | 339/89 |
| 4,059,324 | 11/1977 | Snyder et al. | 339/113 R |
| 4,109,990 | 8/1978 | Waldron et al. | 339/89 |
| 4,202,589 | 5/1980 | Reavis, Jr. et al. | 339/97 |
| 4,239,314 | 12/1980 | Anderson et al. | 339/89 |
| 4,272,144 | 6/1981 | Brush et al. | 339/89 |
| 4,277,125 | 7/1981 | Ball | 339/113 |
| 4,285,564 | 8/1981 | Spinner | 339/89 |
| 4,322,121 | 3/1982 | Riches et al. | 339/89 |

FOREIGN PATENT DOCUMENTS

| | | | |
|---|---|---|---|
| 1188157 | 9/1959 | France | 339/DIG. 2 |
| 2052179 | 1/1981 | United Kingdom | 339/89 M |
| 2059185 | 4/1981 | United Kingdom | 339/113 R |

*Primary Examiner*—John McQuade

*Attorney, Agent, or Firm*—T. E. Kristofferson; T. L. Peterson

[57] ABSTRACT

A self-locking connector is disclosed in which locking of the mating halves of the connector is achieved near complete mating of the connector. The locking mechanism includes a resilient locking ring mounted behind the threads on the coupling nut of the plug connector member. The locking ring is formed with inwardly extending teeth which are engageable with recesses formed in the outer surface of the receptacle connector shell in front of the screw threads thereon.

10 Claims, 3 Drawing Figures

SELF-LOCKING CONNECTOR

CROSS-REFERENCE TO RELATED APPLICATION

Reference is made to co-pending application E. A. Landgreen, Ser. No. 449,359, filed Dec. 13, 1982, assigned to the assignee of the present application, which discloses a self-locking mechanism for a connector which is activated near the end of the mating cycle.

BACKGROUND OF THE INVENTION

The present invention relates generally to a connector and, more particularly, to a self-locking connector in which uncoupling movement of the coupling nut of the connector is restrained.

While the present invention will be described specifically in connection with electrical connectors, it will be appreciated that the invention is adaptable for use with other forms of connectors, such as fiber optic connectors. Typically, the plug and receptacle connector members of an electrical connector are assembled together either by a bayonet type connection, or a threaded coupling nut. The threaded coupling nut is the most mechanically reliable configuration but, unlike the bayonet coupling arrangement, the threaded coupling nut does not inherently include means for resisting uncoupling when the connector is subjected to vibrations or means for audibly indicating when the mating halves of the connector are securely and firmly joined.

When connectors are utilized in aircraft and other vehicles they are often subjected to high vibrations. Consequently, connectors require some means for assuring that the mating halves of the connector will not uncouple, thus assuring electrical integrity during use of the connector. Furthermore, it is desirable to provide in a connector means which produces an audible indication of complete mating of the connector halves since the connector may be mounted in virtually inaccessible locations where visual inspection of the connector is not possible.

Threaded electrical connectors have been developed which have a self-locking mechanism which produces an audible, and sometimes tactile indication of mating of the connector halves. For example, a U.S. Pat. No. 3,552,770 to Heinrich et al. discloses a self-locking electrical connector utilizing balls which cooperate with detents in a clicker plate. U.S. Pat. No. 3,808,580 to Johnson discloses a similar self-locking connector in which rounded dimples are formed on a ring rather than a plurality of balls. U.S. Pat. No. 4,165,910 to Anderson discloses a self-locking connector in which a locking spring embodies radially extending fingers which engage detents formed on the inner surface of a coupling nut. U.S. Pat. No. 3,669,472 to Nadsady discloses a pipe coupling employing an annular ring on one coupling member having axially extending spring fingers cut out and bent forwardly therefrom which engage recesses formed in the front face of the mating coupling member. A similar locking spring is disclosed in U.S. Pat. No. 3,611,260 to Colardeau et al. U.S. Pat. No. 4,291,933 discloses a connector in which a spring sector carried by the coupling nut has a ratchet tooth which engages detent teeth on the plug barrel. The patent suggests that the detent teeth could be formed on the receptacle shell. U.S. Pat. No. 4,152,039 discloses a self-locking connector in which locking ring is integral with the coupling nut. All the aforementioned self-locking coupling arrangements have the disadvantage that the clicking or detenting occurs throughout the mating cycle so that there is not a clear indication of the fully mated condition of the connector assembly.

U.S. Pat. No. 3,594,700 to Nava et al. discloses a self-locking electrical connector employing a generally cylindrical locking ring which is slotted to provide narrow strips which are resilient radially so that projections formed on the strips may resiliently engage teeth formed on the inside of a coupling nut. The ring embodies an inwardly extending annular flange which is trapped between the shells of the mating connector members close to the end of the mating cycle to prevent rotation of the locking ring, so that continued rotation of the coupling nut will produce a clicking action when the detents thereon ride over the projections on the locking spring. U.S. Pat. No. 4,290,622 to Storcel discloses another form of a self-locking connector in which detenting occurs toward the end of the mating cycle by a cam ring being forced axially against detent protrusions formed on a wavespring washer behind the cam ring.

It is the object of the present invention to provide a relatively simple, low-cost and easy to assembly self-locking mechanism for a connector which is activated near the end of the mating engagement of the connector members and provides a clear audible indication of the fully mated condition of the connector.

SUMMARY OF THE INVENTION

According to a principal aspect of the present invention, there is provided a self-locking connector member, typically the plug connector member of a connector assembly, which has a self-locking mechanism associated with the coupling nut that is activated near the end of engagement of the plug connector member with the mating receptacle connector member for resisting rotation of the coupling nut in the uncoupling direction of rotation thereof and producing an audible indication of complete mating. The self-locking mechanism includes a radially resilient locking ring which is fixed to rotate with the coupling nut. The ring has at least one inwardly extending tooth thereon positioned so that the tooth engages with at least one detent recess formed on the shell of the mating receptacle connector member near the end of the mating engagement. This arrangement requires only a minimum number of parts, is low cost and easy to assemble, thus making the locking mechanism of the invention particularly suited for low cost connectors formed of molded plastic parts.

DESCRIPTION OF THE PREFERRED EMBODIMENT

Figure 1:
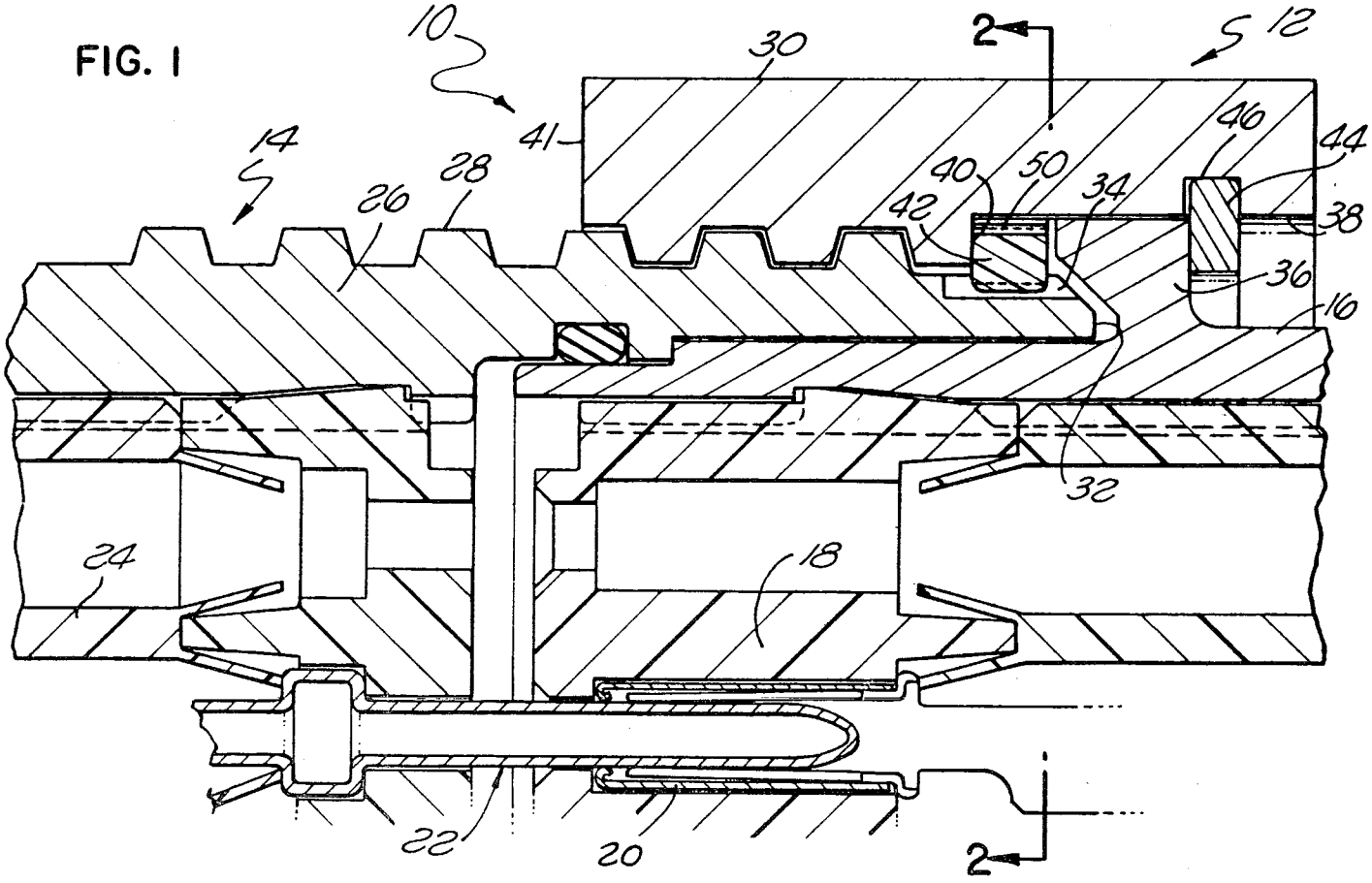
FIG. 1 is a longitudinal sectional view of mated plug and receptacle connector members embodying the self-locking mechanism of the present invention.

Reference is now made to the drawings in detail in which the self-locking coupling mechanism of the present invention is shown as being incorporated in an electrical connector, generally designated 10. The connector comprises a plug connector member 12 which is adapted to mate with a receptacle connector member 14. The plug connector member 12 comprises a barrel 16 containing an insert 18 in which there is mounted a plurality of socket contacts 20 which will mate with pin contacts 22 mounted in the insert 24 inside the receptacle shell 26.

The forward portion of the receptacle shell 26 is threaded, as indicated at 28. The threaded shell 26 is engaged by an internally threaded coupling nut 30 rotatable on the plug barrel 16 so that when the coupling nut is rotated in the coupling direction, typically in the clockwise direction as viewed from the rear of the plug connector member, the plug and receptacle shells will be drawn together to mate the contacts therein. Preferably the thread system is a rapid coupling system such as a multi-start Acme thread which is desirable in order to allow the connector members to be mated with, for example, only 360° rotation of the coupling nut. A finer thread system could be utilized if desired.

Figure 2:
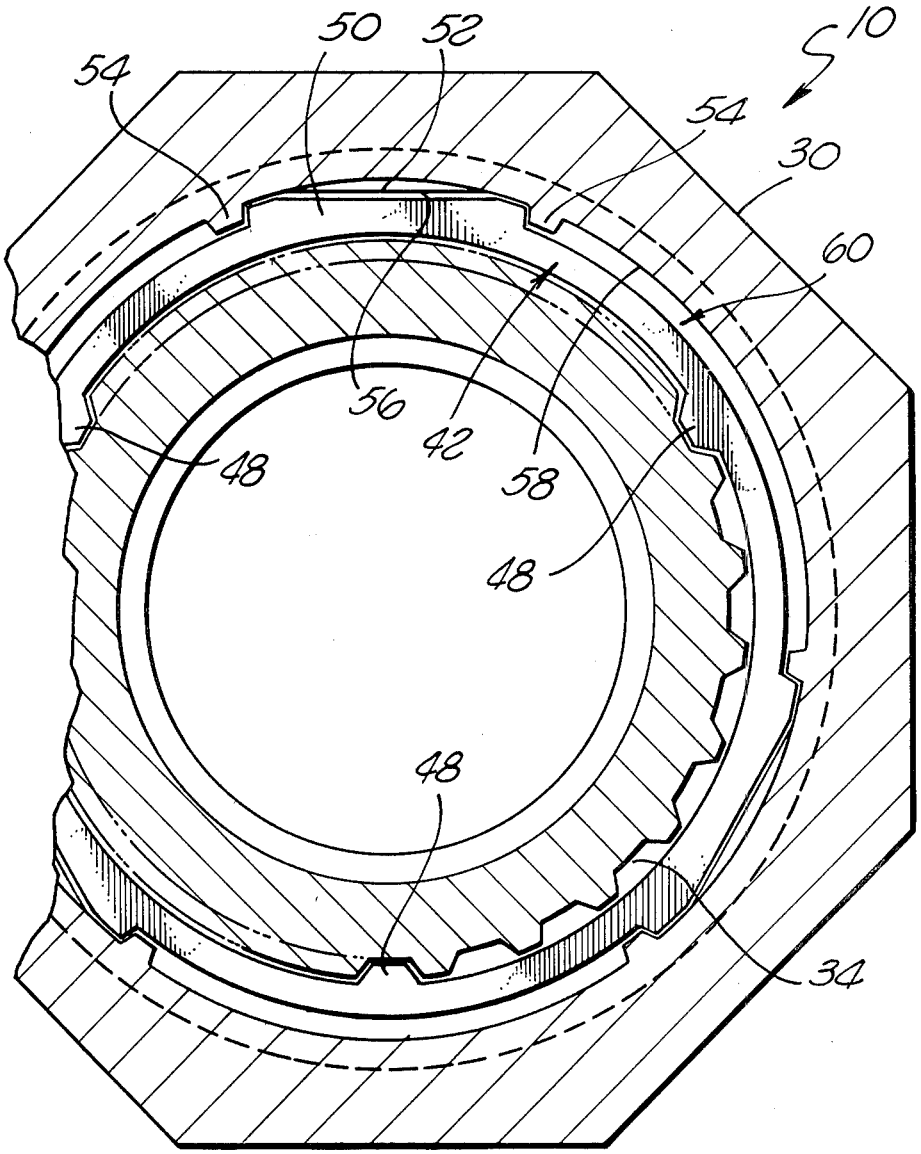
FIG. 2 is a sectional view taken along line 2—2 of FIG. 1 showing the teeth of the locking ring positioned in detent recesses in the receptacle shell, the internal parts of the plug shell not being illustrated.
Figure 3:
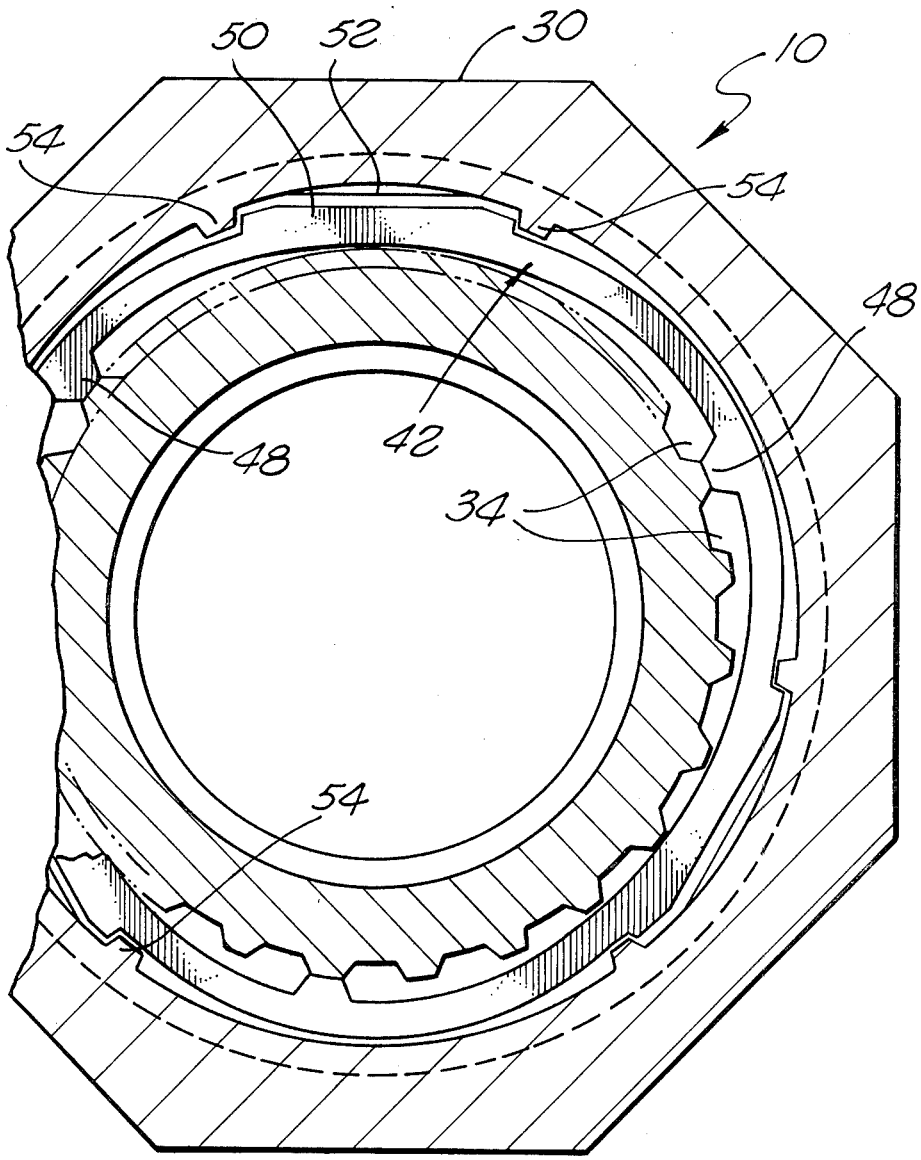
FIG. 3 is a sectional view similar to FIG. 2, but showing the locking ring deflected as the result of the locking teeth on the ring riding over the outer surface of the receptacle shell between the detent recesses thereon.

It is noted that the threads 28 on a receptacle shell commence a short distance behind the forward mating end 32 of the shell leaving a forward annular region in which there is formed a plurality of detent recesses 34. As seen in FIGS. 2 and 3, the recesses are equally spaced around the perimeter of the shell, although they only need to extend partially around the perimeter as will be seen later herein.

The plug barrel 16 is formed with an outwardly extending annular flange 36. The bore through the coupling nut 30 includes a relatively large diameter rear section 38 which is dimensioned to slide over the outer surface of the flange 36 on the barrel 16. The large diameter bore section 38 terminates within the nut at a rearwardly facing annular shoulder 40. The threads on the coupling nut extend from just forward of the shoulder 40 to the front end 41 of the nut. A locking ring 42 is disposed between the shoulder 40 and the flange 36. Thus, the locking ring is positioned behind the threads on the coupling nut. Initially the locking ring is mounted in the rear bore section 38 of the coupling nut. The coupling nut is then installed over the plug barrel from the front thereof whereby the locking ring becomes trapped between the shoulder 40 and the flange 36. A retaining ring 44 is mounted in a groove 46 in the coupling nut behind the flange 36 to retain the coupling nut and locking ring on the barrel 16.

When the plug and receptacle connector members are fully mated, as seen in FIG. 1, the locking ring 42 is axially aligned with the detent recesses 34 formed in the receptacle shell.

Referring now to FIGS. 2 and 3, the locking ring is preferably a continuous ring molded from plastic or other suitable material which is radially resilient. The ring embodies three inwardly extending, equally spaced teeth 48 which are engageable in the detent recesses 34 in the receptacle shell. Three outwardly extending keys 50 are formed on the locking ring which engage within keyways 52 formed by pairs of longitudinally extending ribs 54 formed on the inner surface of the coupling nut 30. Preferably the inner surface 56 of the coupling nut between the ribs 54 of each pair is flattened as are the outer ends of the keys 50 to enhance the bearing surface between the coupling nut and the lockin ring so that the ring will be assured of rotating with the coupling nut when the latter is rotated to interengage the mating receptacle and plug connector members. It is noted that the teeth 48 are spaced midway between the keys 50 and consequently, midway between the pairs of ribs 54. With the teeth 48 lying in the detent recesses 34, the outer arcuate surfaces of the locking ring between the keys 50 thereon are spaced from the inner cylindrical surface 58 of the coupling nut providing arcuate ring expansion gaps 60 therebetween. Consequently, when the coupling nut is rotated causing the teeth 48 to ride out of the recesses onto the outer surface of the receptacle shell, as seen in FIG. 3, the sections of the locking ring between the keys 50 will be free to resiliently deflect outwardly. During such outward deflection of such sections of the ring, the keys 50 will tend to contract inwardly a short distance as seen in FIG. 3.

When the plug and receptacle connector members are initially mated, the threads on the coupling nut will engage with the threads on the receptacle shell drawing the two members together, and the locking ring 42 will be initially spaced from the detent recesses on the shell because the locking ring is mounted behind the threads on the coupling nut. When final mating engagement is approached, whereupon the end of the receptacle shell becomes axially aligned with the locking ring, the teeth 48 on the locking ring will engage the detent recesses 34 on the shell. In the last stage of the mating cycle, rotation of the coupling nut will cause the teeth on the locking ring to snap into several of the recesses in the receptacle shell producing both an audible and tactile indication of complete mating occurring. As will be appreciated, the final engagement of the teeth 48 in the recesses 34 provides a self-locking effect resisting rotation of the coupling nut in the uncoupling direction.

Because the threads on the coupling nut and receptacle shell are of the fast thread type, it would be possible if desired to have the detent recesses 34 formed around only a portion of the perimeter of the receptacle shell, rather than the entire perimeter as shown, provided that the recesses are so located that one of the locking teeth 48 will engage the recesses at the end of the mating cycle. This can be achieved by properly "timing" the locking ring on the coupling nut in the appropriate angular position relative to the detent recesses.

What is claimed is:

1. A connector member adapted to mate with a second connector member having a plurality of detent recesses spaced around at least a portion of its forward mating end comprising:

a barrel having rotatable coupling means thereon for drawing said connector members into mating engagement;

self-locking means associated with said coupling means activated near the end of the mating engagement of said connector members for resisting rotation of the coupling means in the uncoupling direction of rotation thereof;

said self-locking means including a radially resilient locking ring;

said locking ring being fixed to rotate with said coupling means; and said ring having at least one inwardly extending tooth thereon positioned so that said tooth engages with at least one of said detent recesses near the end of said mating engagement.

2. A connector member as set forth in claim 1 wherein:

said locking ring is separate from but keyed to said coupling means.

3. A connector member as set forth in claim 2 wherein:

said coupling means embodies a gap formed in its inner surface outside of said tooth into which said ring may expand when said tooth rides over the outer surface of said forward mating end of the second connector member.

4. A connector member as set forth in claim 1 wherein:

said coupling means comprises a coupling nut internally threaded adjacent to its forward end; and said locking ring is mounted inside said nut behind the threads thereon.

5. A connector member as set forth in claim 4 wherein:

said barrel has an outwardly extending flange therein behind said locking ring;

a rearwardly facing shoulder is formed on the interior of said coupling nut in front of said locking ring;

a retaining ring is mounted on said coupling nut behind said flange to retain said nut axially on said barrel; and said locking ring is installed into the rear of said coupling nut prior to mounting said coupling nut on said barrel from the front of said barrel.

6. A connector member as set forth in claim 1 wherein:

said locking ring is formed of plastic.

7. A connector member as set forth in claim 1 wherein:

said locking ring is separate from said coupling nut and embodies a plurality of said inwardly extending teeth spaced around the inner periphery of said ring;

a plurality of pairs of axially extending ribs are spaced around the inner surface of said coupling means forming arcuate gaps therebetween;

outwardly extending keys are formed on said ring each extending into the space between the ribs of a corresponding pair of ribs so that said ring will rotate with said coupling means;

said teeth being disposed substantially midway between said keys; and the regions of said ring located between said pairs of ribs expanding outwardly into said arcuate gaps when said teeth ride over the outer surface of said forward mating end of the second connector member.

8. A self-locking connector comprising:

mating plug and receptacle connector members;

said plug connector member having an internally threaded coupling nut rotatable on a barrel;

said receptacle connector member having a shell formed with a plurality of detent recesses spaced around at least a portion of its forward mating end;

screw threads on said shell behind said recesses engageable by said coupling nut whereby rotation of said coupling nut in one direction will draw said plug and receptacle connector members into mating engagement;

a radially resilient locking ring behind the threads on said coupling nut and fixed to rotate with said coupling nut; and said ring having at least one inwardly extending tooth thereon engageable with at least one of said detent recesses near the end of said mating engagement when said recesses become axially aligned with said teeth.

9. An electrical connector comprising:

first and second mating connector members;

each said connector member comprising a shell surrounding an insert containing a contact adapted to engage the contact in the other connector member;

a rotatable coupling ring on one of said shells having first coupling means thereon adapted to interengage with second coupling means on the other shell;

radially deformable locking ring means carried by said coupling ring behind said first coupling means;

detent recesses in the exterior of said other shell in front of said second coupling means, said locking ring means and said detent recesses being axially aligned when said connector members are fully mated by said coupling ring; and upon rotation of said coupling ring in one direction to mate said connector members said locking ring means contracting inwardly to engage said detent recesses to releasably lock said coupling ring to said other shell, and upon rotation of said coupling ring in the opposite direction said locking ring means releasing from said detent recesses to allow unmating of said connector members.

10. An electrical connector as set forth in claim 9 wherein:

said locking ring means comprises a circular element having at least two radially inwardly extending projections engaging said recesses when said connector members are fully mated.

* * * * *